United States Patent [19]

Wood

[11] 4,403,689

[45] Sep. 13, 1983

[54] ARTICLE CARRIER

[75] Inventor: Prentice J. Wood, Hapeville, Ga.

[73] Assignee: The Mead Corporation, Dayton, Ohio

[21] Appl. No.: 325,501

[22] Filed: Nov. 27, 1981

[51] Int. Cl.[3] ..... B65D 85/62; B66C 1/10; B65D 75/00

[52] U.S. Cl. ..... 206/158; 206/427; 206/459; 229/52 B; 229/52 BC; 294/87.2

[58] Field of Search ..... 206/158, 140, 148, 199, 206/427, 459; 294/87.2, 87.26; 229/52 BC, 52 B

[56] References Cited

U.S. PATENT DOCUMENTS 3,410,596 11/1968 Slevin, Jr. ..... 206/158

4,339,032 7/1982 Wood ..... 206/158

*Primary Examiner*—William T. Dixson, Jr.

*Attorney, Agent, or Firm*—Rodgers & Rodgers

[57] ABSTRACT

An article carrier comprising a pair of handle panels joined along the upper edges thereof, a pair of side walls integrally joined respectively to the lower edges of the handle panels, a first pair of end wall panels joined respectively to the side edges of one of the side walls, a second pair of end wall panels joined respectively to the side edges of the other side wall, a pair of glue flaps joined respectively to the inner edges of one of the pairs of end wall panels, a pair of reinforcing panels secured respectively in flat face contacting relation with the inner surfaces of the handle panels, and a promotional tab joined to the lower edge of one of the reinforcing panels.

11 Claims, 5 Drawing Figures

ARTICLE CARRIER

TECHNICAL FIELD

This invention relates to article carriers of the top gripping variety which have downwardly projecting article enveloping means joined thereto.

BACKGROUND ART

Top gripping article carriers are known in the art, one of which is disclosed and claimed in U.S. Pat. No. 4,339,032 and which is owned by the assignee of this invention.

DISCLOSURE OF THE INVENTION

By this invention an article carrier is provided and comprises a pair of handle panels foldably joined along the upper edges thereof, a pair of side walls joined respectively to the handle panels and extending downwardly therefrom, a plurality of article receiving apertures formed in the handle panels, end wall panels joined respectively to the end edges of the side walls and extending inwardly of the carrier, a pair of glue flaps joined respectively to one of said end wall panels at each end of the carrier and being adhered respectively to the adjacent end wall panel.

BEST MODE FOR CARRYING OUT THE INVENTION

Figure 1:
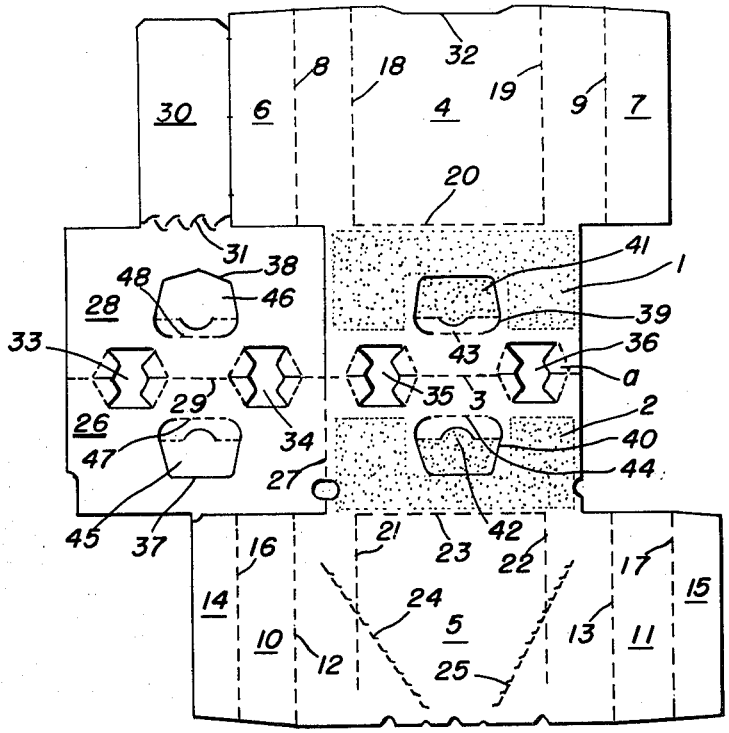
FIG. 1 is a plan view of a blank from which the carrier is formed according to this invention.

With reference to the drawings and with particular reference to FIG. 1, the numeral 1 designates a handle panel of the carrier to the top edge of which handle panel 2 is foldably joined along fold line 3. In addition side walls 4 and 5 are integrally joined respectively to handle panels 1 and 2 along the lower edges thereof. End wall panels 6 and 7 are joined to the sides edges of side wall 4 respectively along fold lines 8 and 9. In similar fashion end wall panels 10 and 11 are joined respectively to the side edges of side wall 5 along fold lines 12 and 13. According to a feature of this invention, glue flaps 14 and 15 are joined respectively to end wall panels 10 and 11 along fold lines 16 and 17.

For the purpose of providing expansion means for the carrier, expansion lines 18 and 19 are formed in side wall 4 and extend downwardly respectively from the ends of crease line 20. Similarly expansion lines 21 and 22 are formed in side wall 5 and extend downwardly respectively from the ends of crease line 23. Also for the purpose of gaining access to the packaged articles, tear lines 24 and 25 are formed in side wall 5.

According to this invention, reinforcing panel 26 is foldably joined to an end edge of handle panel 2 along fold line 27. Also reinforcing panel 28 is foldably joined to reinforcing panel 26 along interrupted fold line 29. In order to facilitate manipulation of the blank, fold line 29 is offset from fold line 3. In addition promotional tab 30 is joined to the lower edge of reinforcing panel 28 along tear line 31. For the purpose of gaining access to promotional tab 30 in the erected carrier, notch 32 is formed in side wall 4.

In order to securely hold the articles within the carrier, article receiving apertures 33, 34, 35 and 36 are provided. More specifically article receiving apertures 33 and 34 are formed in reinforcing panels 26 and 28 and are disposed astride fold line 29. Similarly article receiving apertures 35 and 36 are formed in handle panels 1 and 2 and are disposed astride fold line 3. Each article receiving aperture 33–36 is provided with a plurality of neck securing tabs "a" as is well known.

For the purpose of conveniently transporting the carrier, hand gripping apertures 37, 38, 39 and 40 are provided. Hand gripping apertures 37 and 38 are formed respectively in reinforcing panels 26 and 28 and hand gripping apertures 39 and 40 are formed respectively in handle panels 1 and 2. Attachment flaps 41 and 42 are foldably joined respectively to handle panels 1 and 2 along fold lines 43 and 44. Also attachment flaps 45 and 46 are joined respectively to reinforcing panels 26 and 28 along fold lines 47 and 48.

In order to form the carrier from the blank shown in FIG. 1, initially it is necessary to make an application of glue to handle panels 1 and 2 and attachment flaps 41 and 42 as shown by stippling in FIG. 1. Then it is simply necessary to elevate and fold reinforcing panels 26 and 28 as well as promotional tab 30 upwardly and over to the right along fold line 27. The reinforcing structure then appears as shown in FIG. 2.

Figure 3:
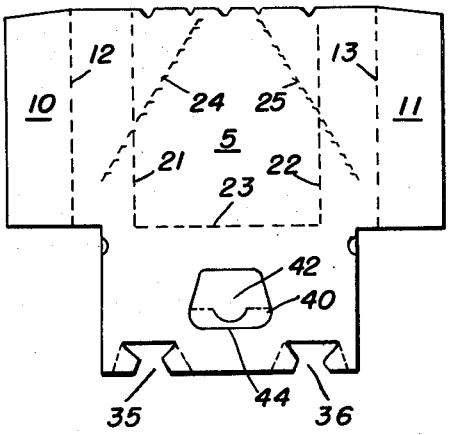
Figure 2:
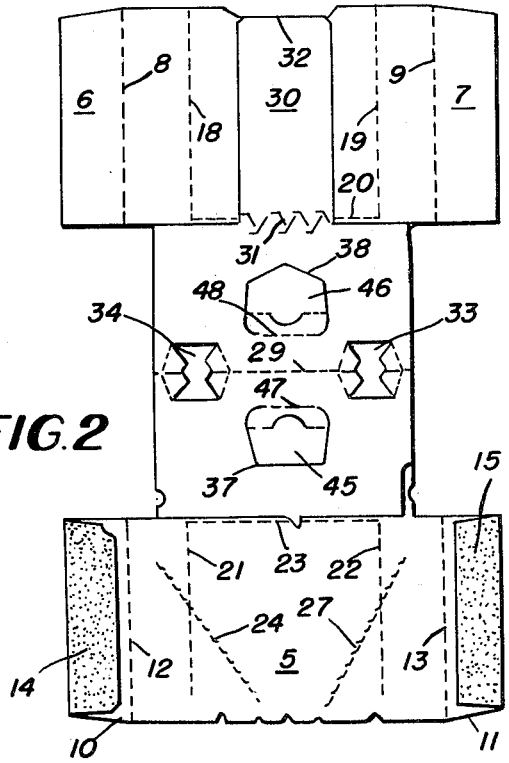
FIG. 2 depicts an intermediate stage through which the blank of FIG. 1 is manipulated and glued in order to form the complete and collapsed carrier as shown in FIG. 3.

Following this glue flaps 14 and 15 are elevated and folded inwardly respectively along fold lines 16 and 17 to occupy the positions shown in FIG. 2. Then an application of glue is made to glue flaps 14 and 15 as well as to attachment flap 45 as shown by stippling in FIG. 2. Then it is necessary to elevate and fold the elements of the blank disposed above fold line 29 upwardly and over into the positions shown in FIG. 3 which represents the carrier in complete and collapsed condition.

Figure 4:
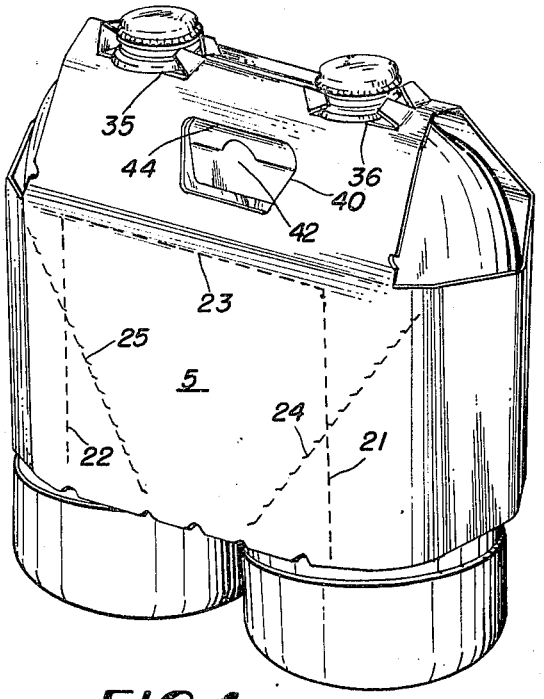
FIG. 4 is a perspective view of a set up carrier with articles disposed therein.
Figure 5:
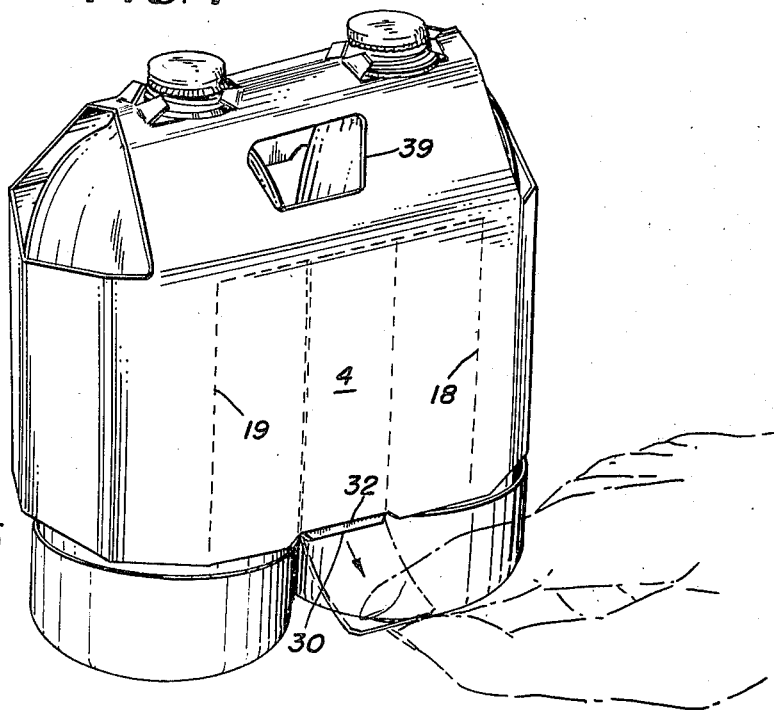
FIG. 5 is a perspective view shown from the rear of FIG. 4.

In order to set up the carrier, it is simply necessary to separate handle panels 1 and 2 and side walls 4 and 5 to positions whereby the carrier can be slipped over a plurality of articles. To complete the packaging operation, the carrier is maneuvered downwardly over the bottles to a position whereby the upper portions of the articles enter the respective article receiving apertures 33–36 as best shown in FIGS. 4 and 5. The articles are then held firmly in place by cooperation between the free ends of securing tabs "a" and the corresponding article caps or flange portions.

Since the glue flaps disposed at the ends of the carrier essentially provide a double thickness of paperboard, stiffer end portions are provided by which the packaging machinery can operate to effectively push the carrier down over the articles. Also as shown in FIG. 5, promotional tab 30 is partially exposed by notch 32 and can be simply grasped and torn off as desired.

INDUSTRIAL APPLICABILITY

By this invention an article carrier is provided which results in increased production speeds and at the same time requires less paperboard material. Also reinforcement is provided in the area of the carrier handle and a promotional capability is available without hindrance to the structural integrity of the carrier.

I claim:

1. An article carrier comprising a pair of handle panels foldably joined along the upper edges thereof, a pair of side walls joined respectively to said handle panels along the lower portions thereof, a plurality of article receiving apertures formed in said handle panels and disposed astride the fold line between said handle panels, end wall panels joined respectively to the end edges of said side walls and extending generally inwardly of the carrier, and a glue flap joined to the inner edge of one of said end wall panels at each end of the carrier and being adhered in overlapping relation to the adjacent end wall panel.

2. An article carrier according to claim 1 wherein a pair of reinforcing panels are disposed respectively in face contacting relation with the inner surface of said handle panels.

3. An article carrier according to claim 2 wherein one of said reinforcing panels is joined to an end edge of the corresponding handle panel.

4. An article carrier according to claim 1 wherein a pair of hand gripping apertures are formed respectively in said handle panels.

5. An article carrier according to claim 1 wherein said side walls are integrally joined respectively to said handle panels.

6. An article carrier comprising a pair of handle panels foldably joined along the upper edges thereof, a pair of side walls joined respectively to said handle panels along the lower portions thereof, a plurality of article receiving apertures formed in said handle panels and disposed astride the fold line between said handle panels, end wall panels joined respectively to the end edges of said side walls and extending generally inwardly of the carrier, a glue flap joined to the inner edge of one of said end wall panels at each end of the carrier and being adhered to the adjacent end wall panel, and a promotional tab joined to the lower edge of one of said reinforcing panels.

7. An article carrier according to claim 6 wherein a notch is formed in one of said side walls and is adapted for cooperation with said promotional tab.

8. An article carrier blank comprising a pair of handle panels joined along a fold line, a pair of side walls joined to said handle panels remote from said fold line, end wall panels joined respectively to the side edges of said side walls, and a pair of glue flaps joined respectively to one of said end wall panels on each side of the blank.

9. An article carrier blank according to claim 8 wherein said pair of glue flaps are joined respectively to the end wall panels disposed at one end of the blank.

10. An article carrier blank according to claim 8 wherein a first reinforcing panel is joined to an end edge of one of said handle panels and a second reinforcing panel is joined to said first reinforcing panel along the upper edge thereof.

11. An article carrier blank according to claim 10 wherein the junction between said first and second reinforcing panels is offset from said fold line.

* * * * *